US006210119B1

(12) United States Patent
Lifson et al.

(10) Patent No.: US 6,210,119 B1
(45) Date of Patent: Apr. 3, 2001

(54) REVERSE ROTATION DETECTION COMPRESSORS WITH A PREFERENTIAL DIRECTION OF ROTATION

(75) Inventors: Alexander Lifson, Manlius; Boris Karpman, DeWitt; John Douglas Lamb, LaFayette, all of NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/092,369

(22) Filed: Jun. 5, 1998

(51) Int. Cl.[7] ..... F04B 49/00

(52) U.S. Cl. ..... 417/18; 19/32; 19/44.1; 19/44.2

(58) Field of Search ..... 417/18, 19, 32, 417/44.1, 44.2, 45

(56) References Cited

U.S. PATENT DOCUMENTS

| | | | | |
|---|---|---|---|---|
| 4,101,819 | * | 7/1978 | Maeda et al. | 323/24 |
| 4,357,502 | * | 11/1982 | Beck | 200/1 |
| 4,696,630 | * | 9/1987 | Sakata et al. | 418/55 |
| 4,969,801 | * | 11/1990 | Haseley et al. | 417/18 |
| 5,211,031 | * | 5/1993 | Murayama et al. | 417/3 |
| 5,219,041 | * | 6/1993 | Greve | 184/108 |
| 5,713,724 | * | 2/1998 | Centers et al. | 417/53 |
| 5,820,349 | * | 10/1998 | Caillat | 417/44.11 |
| 6,017,192 | * | 1/2000 | Clack et al. | 417/18 |

FOREIGN PATENT DOCUMENTS

| | | |
|---|---|---|
| 61-232464 | 10/1986 | (JP) . |
| 63-88066 | 8/1988 | (JP) . |
| 6436583 | 6/1989 | (JP) . |
| 3159019 | 7/1991 | (JP) . |

* cited by examiner

*Primary Examiner*—Charles G. Freay
*Assistant Examiner*—Cheryl J. Tyler
(74) *Attorney, Agent, or Firm*—Carlson, Gaskey & Olds

(57) ABSTRACT

A method is disclosed for identifying when a compressor is being run in reverse due to improper wiring. In a preferred embodiment, sensors sense the condition of a refrigerant at the inlet line and a refrigerant at the outlet line. If an expected pressure differential is not seen, then the determination is made that the compressor is running in reverse. In embodiments the control system may shut down the compressor, provide an alarm, or reverse a phase of two of the three wires of a three phase power input to correct the rotation direction.

10 Claims, 1 Drawing Sheet

REVERSE ROTATION DETECTION COMPRESSORS WITH A PREFERENTIAL DIRECTION OF ROTATION

BACKGROUND OF THE INVENTION

This invention relates to a method and system for detecting reverse rotation of a compressor due to improper wiring.

Compressors are a major component in air conditioning and refrigeration systems. One popular type of compressors is a scroll compressor. In a scroll compressor, a pair of wraps interfit to define a plurality of compression chambers. One of the wraps is driven through an orbit relative to the other, and the compression chambers are reduced in volume such that they compress an entrapped fluid. Scroll compressors are designed to rotate in a forward direction for fluid compression. They are not intended to rotate in the reverse direction during normal operation.

However, if the compressor is improperly wired, or under certain operational conditions, it is possible for the compressor to operate in reverse. Scroll compressors include a motor received in a sealed compressor shell. The refrigerant leading into the compression chambers passes over the motor on its way to the compressor, cooling the motor.

During reverse rotation, little or no refrigerant is pumped through the compressor, and thus the motor can quickly overheat. At the same time, refrigerant is not driven through the compression chambers. Thus the pair of interfitting scroll wraps can also quickly overheat due to heat generated by internal friction between the fixed and orbiting wrap. If reverse rotation is permitted to continue for a long period of time, there is the possibility of damage to the scroll compressor wraps or the motor.

The prior art placed motor protection sensors or line breaks, which would cut off power to the compressor if the motor is overheated. However, this can result in continuous compressor cycling as the motor cools off and compression comes back on line. Then the motor overheats again and the compressor is cycled off.

This of course prevents the compressor from performing its duty of compressing refrigerant, and can lead to potential compressor damage due to continuous cycling. Also the compressor wraps can be damaged due to overheating before the compressor is cycled off.

For residential or commercial applications, it is sometimes possible to detect reverse rotation since it typically results in loud undesirable noise. Since the compressor in a residential or commercial application is typically near occupants, the sound may be noted and corrective measures can take place. However, in typical container refrigeration applications, such as refrigerated transport containers, the compressor and refrigerant system are not mounted near any operator who could hear the sound. Further, such systems include large fans which also generate substantial noise. This noise often masks any increase in the compressor noise.

A three phase compressor is driven by a motor receiving three phase power. Such a compressor can run in reverse, if the connections are miswired at the main power supply or at the connection to the compressor.

The problem of miswiring is especially acute if the connections must be repeatedly made. This is particularly true with three phase compressors in transport container refrigeration where electrical reconnections are frequently made thus increasing the risks of miswiring.

The present invention discloses methods and apparatus for detecting and responding to the detection of compressors running in reverse.

SUMMARY OF THE INVENTION

The present invention detects the occurrence of reverse rotation by comparing the suction and discharge of the compressor to the expected pressures. As an example, the system could look at the pressure differential between the compressor suction and compressor discharge. If the pressure differential is below a minimum value, then a control for the system can identify reverse rotation. If rotation were in the proper direction, then the pressure differential across the compressor will be much greater. Alternatively, the system may only look at the compressor discharge pressure, and determine whether the discharge pressure increases after start-up within a set period of time to a given minimum value. Again, if the pressure does not increase, drops, or stays the same then a determination can be made that the compressor must be running in reverse.

In a first embodiment, if reverse rotation is detected, the system may be shut down and/or an alarm generated. An operator then knows to correct the problem.

In a second embodiment, the system responds by switching the phase on any two of the three wires in the three-phase power supply. By switching these two wires, the system reverses the polarity of the power supply leading to the compressor. This will cause the compressor to begin running in the opposite direction. If the problem that caused the reverse rotation was a miswiring at the compressor, then this reversal may result in other three-phase components in the system connected to the power supply to start running in reverse. Often there are no other three-phase components, thus, it becomes a non-issue. If other three-phase components are present, such as three-phase fans, their operation in reverse is not as detrimental to system and component reliability as compressor operation in a reverse direction. Further, if the problem that caused the compressor to run in reverse has originated at the main power supply, this phase switching will universally correct that problem.

These and other features of the present invention can be best understood from the following specification and drawings, the following of which is a brief description.

DETAILED DESCRIPTION OF A PREFERRED EMBODIMENT

Figure 1:
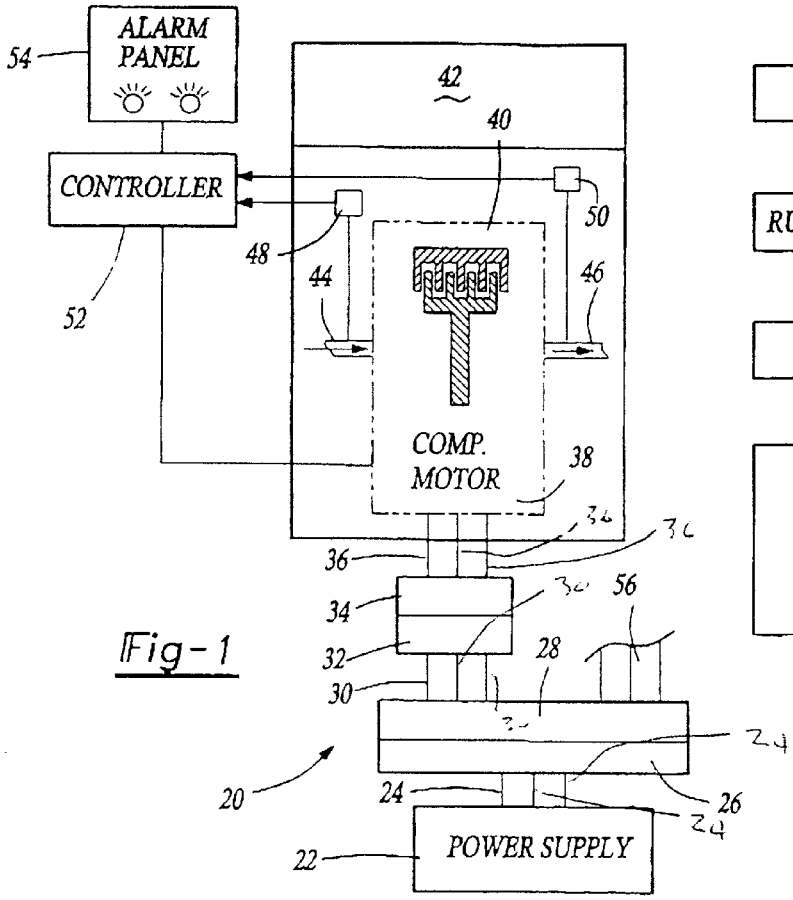
FIG. 1 is a schematic view of the first embodiment of the present invention.

FIG. 1 shows a refrigeration system 20 which receives a three phase power supply 22 having three lines 24 leading to a connector 26. Connector 26 is connected to a system connector 28. Supply lines 30 lead from connector 28 to a second connector 32 connected to a connector 34 having lines 36 leading to a motor 38 for a compressor 40. Motor 38 is a three-phase motor, and there are three lines at each of the power supply stages 24, 30 and 36. Compressor 40 is illustrated as a scroll compressor but can be any other compressor with a preferential direction of rotation. It is desirable for compressor 40 to rotate in one direction, and not in the reverse direction. Thus, there is a proper orientation of the lines 24, 30 and 36 which is achieved when the connections 26 and 28 and 32 and 34 are properly made. However, should a single connector 26, 28 or 32, 34, be improperly connected, then the power supply to motor 38 is improper and the compressor 40 will be driven in a reverse direction from that which is desired.

The compressor 40 is shown schematically and is a key element for providing cooling to refrigerated transport container 42. This transport container may be of the known type which are utilized to transport food products or other items which must be maintained at a set temperature. This known type of transport container may be shipped on a boat, carried on a railcar, and eventually transported by truck on a trailer. During this entire travel, the container 42 must be kept at a set temperature. During the connection and disconnection of the refrigeration system 20, and further with routine maintenance, replacement, etc., it is possible that connectors 26, 28 or 32 and 34 may be improperly connected, thus, resulting in a reverse rotation of the compressor at start-up. It would be desirable to provide an indication to an operator of the miswiring as soon as possible.

As shown schematically, a suction line 44 leads to compressor 40 and a discharge line 46 leads from the compressor 40. Pressure sensors 48 and 50 are placed on lines 44 and 46, respectively. The pressure sensors 48 and 50 send signals to a controller 52. Controller 52 communicates to alarm panel 54, and to motor 38.

At the start-up of the compressor, suction and discharge pressure should be equal as pressure equalization occurs over time. However, on start-up, the pressure seen at discharge line 46 should quickly increase relative to the pressure seen at suction inlet line 44. Thus, the controller 52 may compare the signals from sensors 48 and 50, and if a predetermined minimum differential is not established within a set period of time, the controller 52 can identify the motor as running in reverse. When the motor is identified as being run in reverse, an action is taken. In the preferred embodiment, the motor 38 is stopped, and a signal is sent to the operator through alarm panel 54. Of course, the signal can be visual, audio, etc.

Alternative ways of determining that the compressor is running in reverse based upon system parameters can also be used. As an example, only a discharge pressure sensor may be used. In this case it may only be necessary to measure the discharge pressure at or before start-up, and compare it to the discharge pressure at some period of time after start-up. If there is no pronounced change in discharge pressure, the controller may identify the system as running in reverse. In addition, rather than monitoring pressure, the temperatures or other parameters inside or outside of the compressor, evaporator, or condenser could be measured.

Figure 2:
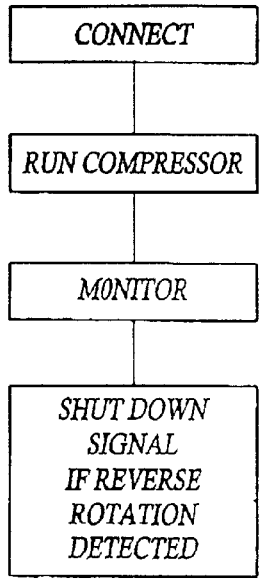
FIG. 2 is a flow chart of the inventive system.

FIG. 2 is a flow chart for this method. The first step is electrically connecting the system and running the system and compressor. The controller monitors the inlet and outlet pressures while the compressor is running, and shuts down and/or sends signals when a determination is made that the compressor is running in reverse.

Figure 3:
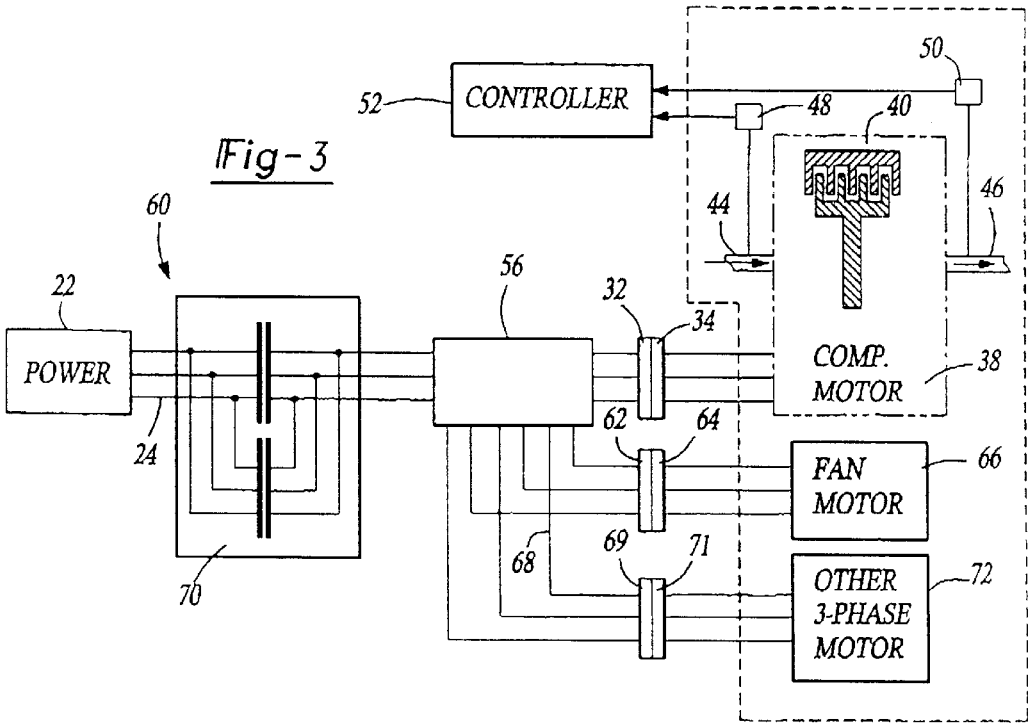
FIG. 3 is a schematic of a second embodiment of the invention.

FIG. 3 shows a second embodiment 60 wherein power supplies and controls are similar to those used in the first embodiment and are identified by the same reference numerals. In embodiment 60, feeder junction 56 leads to a connector 62 connected to a connector 64 for a fan motor 66. A similar supply 68 may lead to a connector 69 and 71 for other three phase motors 72. The system in the second embodiment identifies reverse rotation in the same manner as the first embodiment. However, rather than shutting down the motor or signaling the reverse rotation to the operator, a phase changing member 70 is placed in the line between the power supply 22 and a feeder junction 56. Such phase change mechanisms are known in the field of three-phase motors. When reverse rotation is detected, the phase change element 70 reverses the phase of any two of the three power supply lines. This will necessarily result in the compressor beginning to run in the opposite direction from that which it had been previously running.

With this system, should reverse rotation be detected at the compressor, the phase shift is made and the compressor will begin to run in the opposite direction. If the miswiring is at the main power supply line, this will correct any miswiring. However, if the miswiring is at the connection 32 and 34, the other three phase motors 66 and 72 will now be running in reverse. Even though it may not be desirable for the fan and other system devices to run in reverse, this typically does not result in their damage or cause improper system operation. The compressor however will most probably be damaged after running in reverse for a set time period.

It should be understood that other fluid characteristics, in addition to discharge and/or suction compressor pressure, in the refrigeration cycle could be monitored within the scope of this invention. As an example, the temperature at the inlet or the outlet of the compressor could be sensed. Alternatively, the temperature at compressor upstream locations such as the evaporator or compressor downstream locations such as condenser can be monitored. The main aspect of this invention is the monitoring of a refrigerant system characteristic to determine when reverse rotation is occurring.

Preferred embodiments of this invention have been disclosed, however, workers of ordinary skill in the art would recognize that certain modifications will come within the scope of this invention. For that reason, the following claims should be studied to determine the true scope and content of this invention.

What is claimed is:

1. A system comprising:

a power supply;

a compressor and an electric motor for driving said compressor;

a connector for connecting said power supply to said motor; and a control being provided with a signal indicative of at least one characteristic of a refrigerant passing through said compressor, and said control operable to make a determination of whether said compressor is running in reverse based upon said signal, said control also being able to generate an output signal when a determination is made that said compressor is running in reverse, said compressor being a scroll compressor, said power supply being a three-phase power supply, said output signal being sent to a phase reversal unit, said phase reversal unit being disposed between said power supply and said motor, said phase reversal unit reversing the phase of at least two of the three lines of said three-phase power supply to reverse the rotation direction of said motor back to a forward direction.

2. A system as recited in claim 1, wherein there is a sensor for sensing a refrigerant characteristic leading into said compressor and a sensor for sensing a refrigerant discharge characteristic leading from said compressor, each said sensors sending a signal to said control.

3. A system as recited in claim 1, wherein said output from said control sends a signal that reverse rotation is occurring.

4. A system as recited in claim 1, wherein said control compares the inlet pressure to the outlet pressure and determines whether an expected pressure differential exists.

5. A system as recited in claim 1, wherein said control compares the discharge pressure at a first time to the discharge pressure after a period of time to determine whether reverse rotation is occurring.

6. A system as recited in claim 1, wherein said control compares a suction temperature to an expected suction temperature.

7. A system as recited in claim 1, wherein control compares a discharge temperature to an expected discharge temperature.

8. A system as recited in claim 7, wherein said control also compares a suction temperature to an expected suction temperature.

9. A system as recited in claim 1, wherein said characteristic is the suction pressure.

10. A system as recited in claim 1, wherein a supply of a refrigerant is connected to said compressor, and said compressor has a discharge connection.

* * * * *